US011444380B2

(12) United States Patent
Shamblin

(10) Patent No.: US 11,444,380 B2
(45) Date of Patent: Sep. 13, 2022

(54) ANTENNA SYSTEM HAVING STACKED ANTENNA STRUCTURES

(71) Applicant: AVX Antenna, Inc., San Diego, CA (US)

(72) Inventor: John Eric Shamblin, San Diego, CA (US)

(73) Assignee: KYOCERA AVX Corporation (San Diego), Inc., San Diego, CA (US)

( * ) Notice: Subject to any disclaimer, the term of this patent is extended or adjusted under 35 U.S.C. 154(b) by 0 days.

(21) Appl. No.: 16/751,333

(22) Filed: Jan. 24, 2020

(65) Prior Publication Data

US 2020/0243977 A1 Jul. 30, 2020

Related U.S. Application Data

(60) Provisional application No. 62/834,661, filed on Apr. 16, 2019, provisional application No. 62/798,762, filed on Jan. 30, 2019.

(51) Int. Cl.

| | |
|---|---|
| ***H01Q 9/04*** | (2006.01) |
| ***H01Q 5/30*** | (2015.01) |
| ***H01Q 1/48*** | (2006.01) |
| ***H01Q 5/50*** | (2015.01) |
| *H01Q 25/00* | (2006.01) |

(52) U.S. Cl.

CPC ..... *H01Q 9/0414* (2013.01); *H01Q 1/48* (2013.01); *H01Q 5/30* (2015.01); *H01Q 5/50* (2015.01); *H01Q 25/005* (2013.01)

(58) Field of Classification Search

CPC .. H01Q 9/0414; H01Q 9/0421; H01Q 9/0442; H01Q 9/513; H01Q 5/335

See application file for complete search history.

(56) References Cited

U.S. PATENT DOCUMENTS 7,528,780 B2 * 5/2009 Thiam ..... H01Q 9/0414 343/700 MS 9,825,373 B1 11/2017 Smith (Continued)

FOREIGN PATENT DOCUMENTS

JP H 082113825 8/1996

JP 5709805 4/2015

(Continued)

OTHER PUBLICATIONS

International Search Report and Written Opinion for Application No. PCT/US2020/014029, dated May 20, 2020, 11 pages.

(Continued)

*Primary Examiner* — Graham P Smith

(74) *Attorney, Agent, or Firm* — Dority & Manning, P.A.

(57) ABSTRACT

An antenna system is provided. The antenna system includes a circuit board. The antenna system further includes a first antenna structure and a second antenna structure. The first antenna structure is positioned between the circuit board and the second antenna structure such that the first antenna structure forms a ground plane for the second antenna structure. In addition, the first antenna structure is electrically coupled to the circuit board via a first conductive path. The second antenna structure is electrically coupled to the circuit board via a second conductive path extending through an opening defined by the first antenna structure.

17 Claims, 19 Drawing Sheets

(56) References Cited

U.S. PATENT DOCUMENTS

| | | | | |
|---|---|---|---|---|
| 2004/0032368 | A1* | 2/2004 | Spittler | H01Q 9/0421 343/700 MS |
| 2006/0012524 | A1 | 1/2006 | Mierke et al. | |
| 2009/0066593 | A1* | 3/2009 | Jared | H01Q 1/3275 343/713 |
| 2011/0199279 | A1* | 8/2011 | Shen | H01Q 9/0435 343/857 |
| 2013/0099982 | A1* | 4/2013 | Andrenko | H01Q 5/40 343/700 MS |
| 2014/0361952 | A1* | 12/2014 | Dobric | H01Q 1/3275 343/893 |
| 2015/0333407 | A1* | 11/2015 | Yamagajo | H01Q 5/40 343/905 |
| 2017/0093041 | A1 | 3/2017 | McMichael | |
| 2017/0294717 | A1* | 10/2017 | Zhang | H01Q 19/005 |
| 2018/0205138 | A1* | 7/2018 | Osawa | H01Q 9/0442 |
| 2018/0331428 | A1 | 11/2018 | Iino | |

FOREIGN PATENT DOCUMENTS

| | | |
|---|---|---|
| JP | 2019009544 A | 1/2019 |
| KR | 100732666 | 7/2007 |
| KR | 20180013203 | 2/2018 |

OTHER PUBLICATIONS

Mcvay, Miniaturization of top-loaded monopole antennas using Peano-curves, IEEE Radio and Wireless Symposium, Jan. 11, 2007, 4 pages.

Extended European Search Report for Application No. 20748600.2, dated Jul. 20, 2022, 9 pages.

Japanese Office Action for Application No. JP 2021-544494, dated Jun. 20, 2022, 10 pages.

* cited by examiner

ANTENNA SYSTEM HAVING STACKED ANTENNA STRUCTURES

PRIORITY CLAIM

The present application claims the benefit of priority of U.S. Provisional App. No. 62/798,762, titled "Antenna System Having Stacked Antenna Structures," having a filing date of Jan. 30, 2019, which is incorporated by reference herein. The present application also claims the benefit of priority of U.S. Provisional App. No. 62/834,661, titled "Antenna System Having Stacked Antenna Structures," having a filing date Apr. 16, 2019, which is incorporated by reference herein.

FIELD

The present disclosure relates generally to antenna systems and, more specifically, to antenna systems having stacked antenna structures.

BACKGROUND

Antennas can be used to transmit and receive data between two devices. Some devices can include multiple antennas to provide communication over multiple frequency bands and support high data rates associated with communication standards, such as long term evolution (LTE). For example, hand-held devices (e.g., smartphones) can include two antennas. Of the two antennas, one can be tuned to a first frequency and configured to transmit and receive data. The other antenna can be tuned to a second frequency that is different than the first frequency and can be configured to receive data.

SUMMARY

Aspects and advantages of embodiments of the present disclosure will be set forth in part in the following description, or may be learned from the description, or may be learned through practice of the embodiments.

In one aspect, an antenna system is provided. The antenna system can include a circuit board, a first antenna structure and a second antenna structure. The first antenna structure can be positioned between the circuit board and the second antenna structure to provide a ground plane for the second antenna structure. In addition, the first antenna structure can be electrically coupled to the circuit board via a first conductive path. The second antenna structure can be electrically coupled to the circuit board via a second conductive path extending through an opening defined by the first antenna structure.

In another aspect, a module is provided. The module includes a housing and an antenna system disposed within the housing. The antenna system includes a circuit board. The antenna system further includes a first antenna structure tuned to a first frequency and a second antenna structure tuned to a second frequency that is different than the first frequency. The first antenna structure is positioned between the circuit board and the second antenna structure such that the first antenna structure provides a ground plane for the second antenna structure. Furthermore, the first antenna structure is coupled to the circuit board via a first conductive path. The second antenna structure is coupled to the circuit board via a second conductive path that extends through an opening defined by the first antenna structure.

In yet another aspect, an antenna system is provided. The antenna system includes a circuit board. The antenna system further includes a first antenna structure tuned to a first frequency and a second antenna structure tuned to a second frequency that is different than the first frequency. The first antenna structure is positioned between the circuit board and the second antenna structure to provide a ground plane for the second antenna structure. Furthermore, the first antenna structure and the second antenna structure are each coupled to the circuit board via the same conductive antenna feed path.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
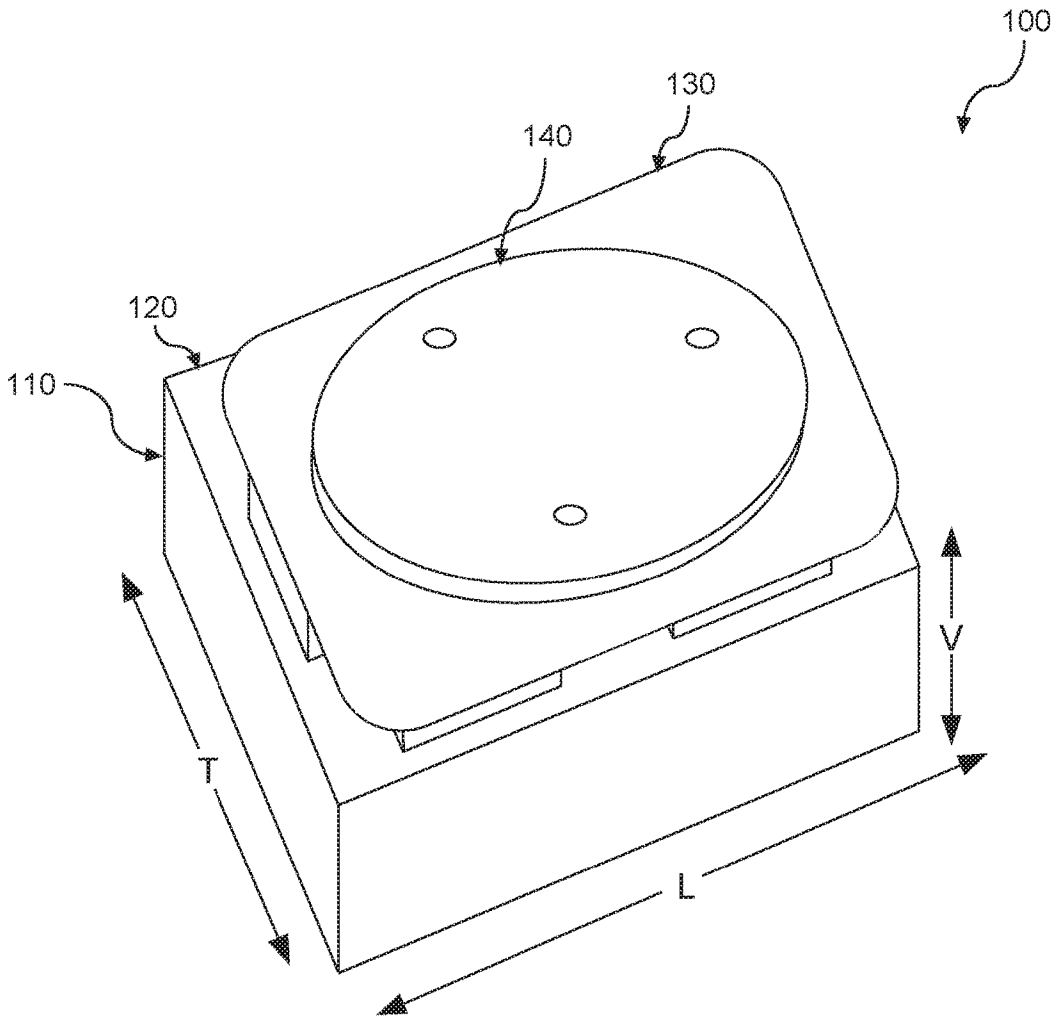
FIG. 1 depicts an antenna system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to an antenna system. The antenna system can include a first antenna structure and a second antenna structure. The first antenna structure can be tuned to a first frequency. The second antenna structure can be tuned to a second frequency. In some implementations, the second frequency can be different than the first frequency. For instance, the second frequency can be higher than the first frequency. In some implementations, the first frequency can include a range of frequencies spanning from about 722 MHz to about 728 MHz. Alternatively or additionally, the first frequency can include a range of frequencies spanning from about 1915 MHz to about 1920 MHz. In some implementations, the second frequency can include a range of frequencies spanning from about 1995 MHz to about 2020 MHz.

The first antenna structure can be disposed between the second antenna structure and a circuit board of the antenna system. In addition, the first antenna structure and the second antenna structure can each be coupled to the circuit board. In some implementations, the first antenna structure and the second antenna structure can be coupled to the circuit board via the same conductive antenna feed paths. In alternative implementations, the first antenna structure and the second antenna structure can be electrically coupled to the circuit board via separate conductive antenna feed paths. For instance, the first antenna structure can be electrically coupled to the circuit board via a first conductive antenna feed path. Conversely, the second antenna structure can be electrically coupled to the circuit board via a second conductive antenna feed path that is different than the first conductive antenna feed path. The second conductive antenna feed path can extend through an opening defined by the first antenna structure.

In some implementations, the first antenna structure can be electrically grounded to the circuit board (e.g. a conductive ground plane on the circuit board) via one or more grounding or shorting posts. In addition, the second antenna structure can be electrically grounded to the first antenna structure via one or more shorting posts. In some implementations, the antenna system can include a substrate disposed between the circuit board and the first antenna structure. The substrate can define a plurality of openings to accommodate the antenna feed path(s) and the shorting posts. In this manner, the conductive antenna feed path(s) and the shorting posts can pass through the substrate via the openings.

In some implementations, a cross-sectional area of the first antenna structure can be greater than a cross-sectional area of the second antenna structure. In this manner, the first antenna structure can act as a ground plane for the second antenna structure. In some implementations, a shape of the first antenna structure can be different than a shape of the second antenna structure. For instance, the shape of the first antenna structure can be rectangular. Conversely, the shape of the second antenna structure can be annular. It should be appreciated that the first antenna structure and the second antenna structure can have any suitable shape so long as the cross-sectional area of the first antenna structure is greater than the cross-sectional area of the second antenna structure.

The antenna system according to example aspects of the present disclosure can provide numerous technical effects and benefits. For instance, the second antenna structure of the antenna system can be positioned on top of the first antenna structure of the antenna system to reduce the footprint of the antenna system. In addition, the cross-sectional area of the first antenna structure can be greater than the cross-sectional area of the second antenna structure. In this manner, the first antenna structure can provide a ground plane for the second antenna structure.

As used herein, the use of the term "about" in conjunction with a numerical value is intended to refer to within 20% of the stated amount. In addition, the terms "first," "second," and "third" may be used interchangeably to distinguish one component from another and are not intended to signify location or importance of the individual components.

Referring now to the FIGS, FIG. 1 depicts an antenna system 100 according to example embodiments of the present disclosure. As shown, the antenna system 100 can define a coordinate system that includes a lateral direction L, a transverse direction T and a vertical direction V. In some implementations, the antenna system 100 can include a power supply 110 (e.g., a battery) configured to provide electrical power to one or more components of the antenna system 100. As shown, the antenna system 100 can include a circuit board 120 having one or more electrical components (e.g., capacitors, resistors, inductors, conductive ground plane, integrated circuits, processors, etc.). In some implementations, the circuit board 120 can be electrically coupled to the power supply 110. In this manner, the circuit board 120 can receive electrical power from the power supply 110.

As shown, the antenna system 100 can include a first antenna structure 130 and a second antenna structure 140. In some implementations, the first antenna structure 130 can be tuned to a first frequency. Conversely, the second antenna structure 140 can be tuned to a second frequency that is different than the first frequency. For instance, the first frequency can be lower than the second frequency. In some implementations, the first frequency can include a range of frequencies spanning from about 722 MHz to about 728 MHz. Alternatively or additionally, the first frequency can include a range of frequencies spanning from about 1915 MHz to about 1920 MHz. In some implementations, the second frequency can include a range of frequencies spanning from about 1995 MHz to about 2020 MHz.

In some implementations, the first antenna structure 130 can be configured to transmit and receive data. For instance, the first antenna structure 130 can be configured to transmit data via a RF signal having a first frequency within the range spanning from about 722 MHz to about 728 MHz. Additionally, the first antenna structure 130 can be configured to receive data via a RF signal having a frequency included within the range spanning from about 1915 MHz to about 1920 MHz. In some implementations, the second antenna structure 140 can be configured to receive data when tuned to the second frequency.

It should be appreciated that the first antenna structure 130 and the second antenna structure 140 can include any suitable type of antenna. For instance, in some implementations, the first antenna structure 130 and the second antenna structure 140 can each include a top loaded monopole S antenna having one or more shorting posts.

Figure 2:
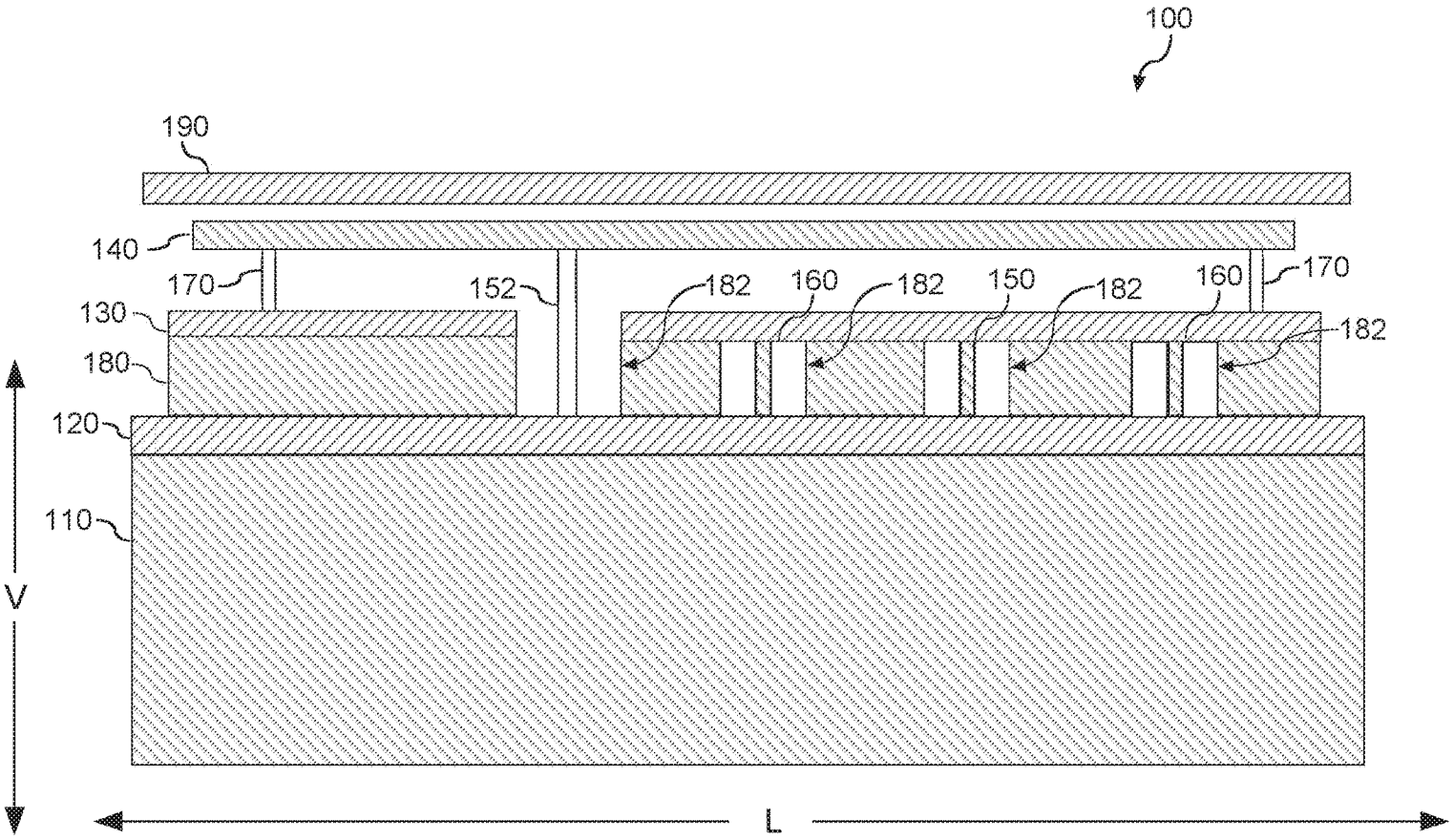
FIG. 2 depicts a cross-sectional view of an antenna system according to example embodiments of the present disclosure.

Referring now to FIG. 2, a cross-sectional view of the antenna system 100 is provided. As shown, the first antenna structure 130 can be disposed between the circuit board 120 and the second antenna structure 140. More specifically, the first antenna structure 130 can be disposed between the circuit board 120 and the second antenna structure 140 along the vertical direction V. In addition, a cross-sectional area of the first antenna structure 130 can be different than a cross-sectional area of the second antenna structure 140. More specifically, the cross-sectional area of the first antenna structure 130 can be larger than the cross-sectional area of the second antenna structure 140. In this manner, the first antenna structure 130 can provide a ground plane for the second antenna structure 140.

In some implementations, a shape of the first antenna structure 130 can be different than a shape of the second antenna structure 140. For instance, the shape of the first antenna structure 130 can be rectangular. Conversely, the shape of the second antenna structure 140 can be annular (e.g., ring, circle, oval). It should be appreciated, however, that the first antenna structure 130 and the second antenna structure 140 can have any suitable shape so long as the cross-sectional area of the first antenna structure 130 is greater than the cross-sectional area of the second antenna structure 140.

In some implementations, a cross-sectional area of a ground plane on the circuit board 120 can be different than the cross-sectional area of the first antenna structure 130. For instance, the cross-sectional area of the ground plane on the circuit board 120 can be larger than the cross-sectional area of the first antenna structure 130. As will be discussed below in more detail, the first antenna structure 130 and the second antenna structure 140 can each be electrically coupled to the circuit board 120.

Figure 3:
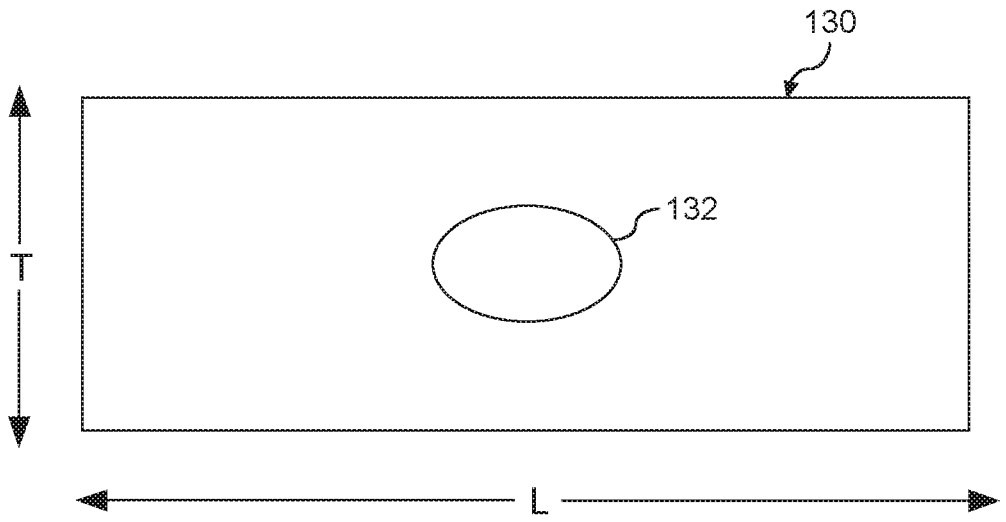
FIG. 3 depicts a top down view of a first antenna structure of the antenna system of FIG. 2 according to example embodiments of the present disclosure.

In some implementations, the first antenna structure 130 and the second antenna structure 140 can each be electrically coupled to the circuit board 120 via separate conductors (e.g., conductive posts). For instance, the first antenna structure 130 can be electrically coupled to the circuit board 120 via a first conductive antenna feed path 150 (e.g., coax antenna feed path). Conversely, the second antenna structure 140 can be electrically coupled to the circuit board 120 via a second conductive antenna feed path 152 (e.g., coax antenna feed path). In some implementations, the second conductive antenna feed path 152 can extend through an opening 132 (FIG. 3) defined by the first antenna structure 130.

In some implementations, the first antenna structure 130 can be electrically grounded to the circuit board 120 (e.g. a ground plane on the circuit board 120) via one or more shorting posts 160. It should be appreciated that any suitable number of shorting posts 160 can be used to electrically ground the first antenna structure 130 to the circuit board 120. For instance, in some implementations, the first antenna structure 130 can be electrically grounded to the circuit board 120 via two shorting posts 160. In alternative implementations, the first antenna structure 130 can be electrically grounded to the circuit board 120 via more or fewer shorting posts 160.

In some implementations, the second antenna structure 140 can be electrically grounded to the first antenna structure 130 via a plurality of shorting posts 170. For instance, in some implementations, the second antenna structure 140 can be electrically grounded to the first antenna structure 130 via two shorting posts 170. In alternative implementations, the second antenna structure 140 can be electrically grounded to the first antenna structure 130 via more or fewer shorting posts 170.

In some implementations, the antenna system 100 can include a substrate 180 disposed between the circuit board 120 and the first antenna structure 130. The substrate 180 can include a polymer material (e.g., polycarbonate material) having a relatively permittivity, $\varepsilon_r$, of about 3. It should be appreciated, however, that the substrate 180 can include any suitable material. It should also be appreciated that the substrate 180 can define a plurality of openings 182. In this manner, the first conductor 150, second conductor 152, and plurality of shorting posts 160 can each extend through a corresponding opening of the plurality of openings 182 defined by the substrate 180.

In some implementations, the antenna system 100 can include a cover 190. As shown, the first antenna structure 130 and the second antenna structure 140 can be positioned between the circuit board 120 and the cover 190 along the vertical direction V. In addition, a cross-sectional area of the cover 190 can be larger than a cross-sectional area of the first antenna structure 130 and a cross-sectional area of the second antenna structure 140. In this manner, the first antenna structure 130 and the second antenna structure 140 can be covered via the cover 190. It should be appreciated that the cover 190 can include any suitable material. For instance, in some implementations, the cover 190 can include plastic (e.g., polyurethane). It should also be appreciated that the cover 190 can be any suitable size. For instance, in some implementations, a thickness of the cover 190 as measured along the vertical direction V can be about 2 millimeters.

Figure 4:
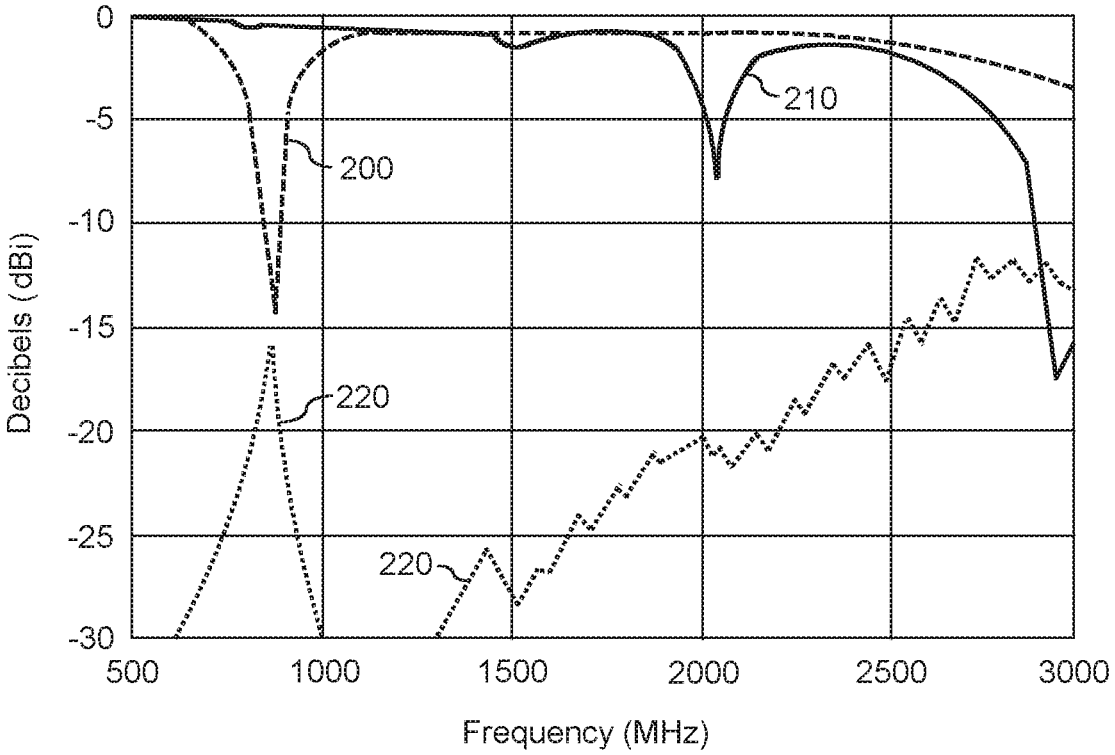
FIG. 4 depicts a graphical representation of return loss associated with an antenna system according to example embodiments of the present disclosure.

Referring now to FIG. 4, a graphical representation of return loss of the antenna system 100 (FIG. 1) is provided according to example embodiments of the present disclosure. As shown, the graph illustrates return loss (denoted along the vertical axis in decibels) of the antenna system as a function of frequency (denoted along the horizontal axis in Megahertz). More specifically, the graph illustrates return loss of the antenna system over a range of frequencies that spans from 500 megahertz (MHz) to 3000 MHz. As shown, curve 200 depicts the return loss associated with the first antenna structure 130 (FIG. 1) over the range of frequencies. In addition, curve 210 depicts the return loss associated with the second antenna structure 140 (FIG. 1) over the range of frequencies. Furthermore, curve 220 depicts the isolation between the first antenna structure 130 and the second antenna structure 140.

Figure 5:
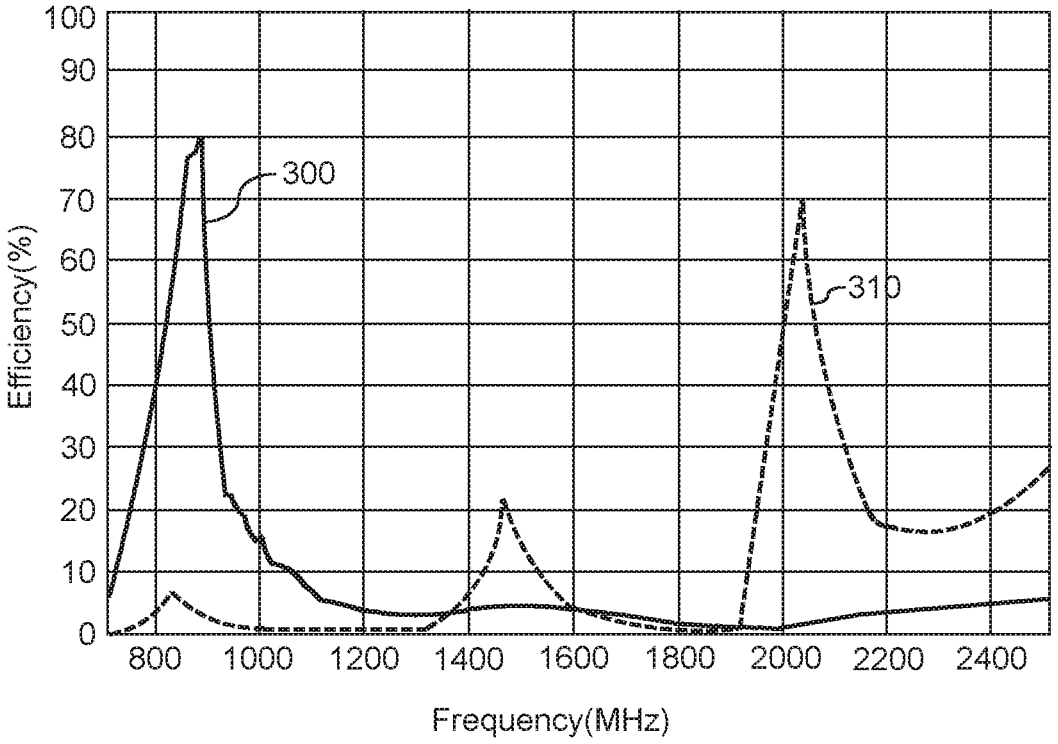
FIG. 5 depicts a graphical representation of efficiency of an antenna system according to example embodiments of the present disclosure.

Referring now to FIG. 5, a graphical representation of efficiency of the antenna system 100 (FIG. 1) is provided according to example embodiments of the present disclosure. As shown, the graph illustrates efficiency (denoted along the vertical axis as a percentage) of the antenna system 100 as a function of frequency (denoted along the horizontal axis megahertz). More specifically, the graph illustrates the efficiency of the antenna system over a range of frequencies that spans from about 700 MHz to about 2400 MHz. It should be appreciated that the efficiency of an antenna represents a ratio of power delivered to the antenna relative to the power radiated by the antenna. As shown, curve 300 depicts the efficiency of the first antenna structure 130 (FIG. 1) over the range of antenna frequencies. In addition, curve 310 depicts the efficiency of the second antenna structure 140 (FIG. 1) over the range of frequencies. As depicted, the first antenna structure 130 is most efficient when tuned to a frequency between 800 MHz and 1000 MHz. Conversely, the second antenna structure 140 is most efficient when tuned to a frequency between 2000 MHz and 2200 MHz.

Figure 6:
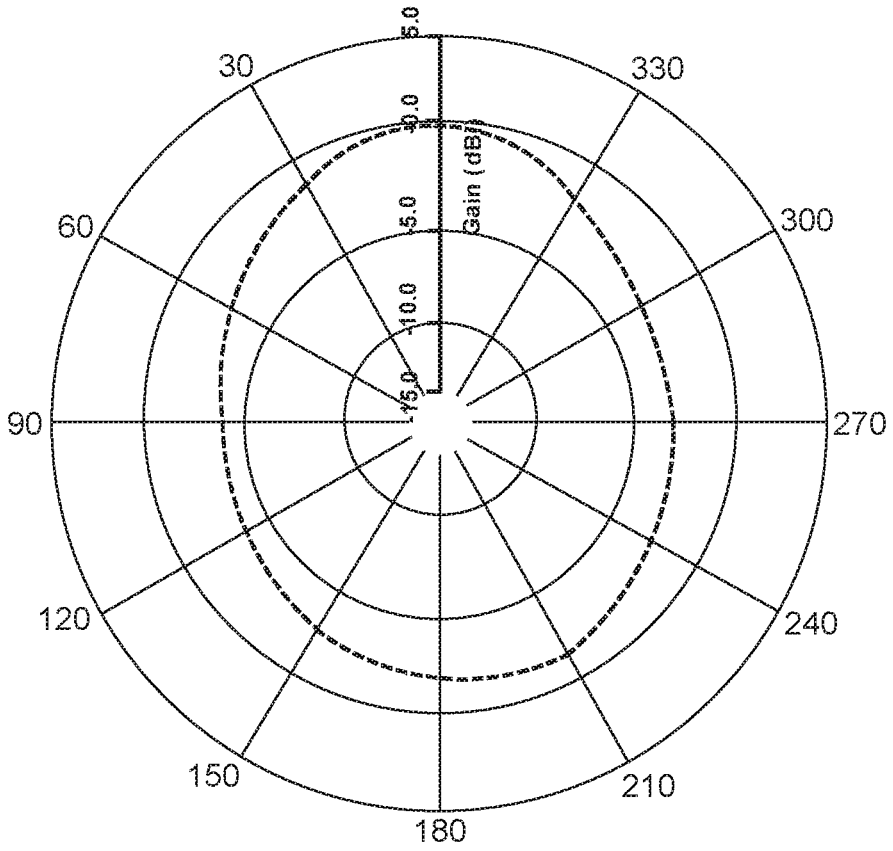
FIG. 6 depicts a graphical representation of an azimuthal radiation pattern associated with a first antenna structure of an antenna system according to example embodiments of the present disclosure.

Referring now to FIG. 6, a graphical representation of an azimuthal plane radiation pattern associated with the first antenna structure 130 (FIG. 1) according to example embodiments of the present disclosure. More specifically, the graph depicts the azimuthal plane radiation pattern of the first antenna structure 130 when tuned to the first frequency (e.g., about 725 MHz). As shown, the gain of the first antenna structure 130 is generally uniform in the azimuthal plane. In this manner, the azimuthal radiation pattern associated with the first antenna structure 130 can be considered omnidirectional when the first antenna structure 130 is tuned to the first frequency.

Figure 7:
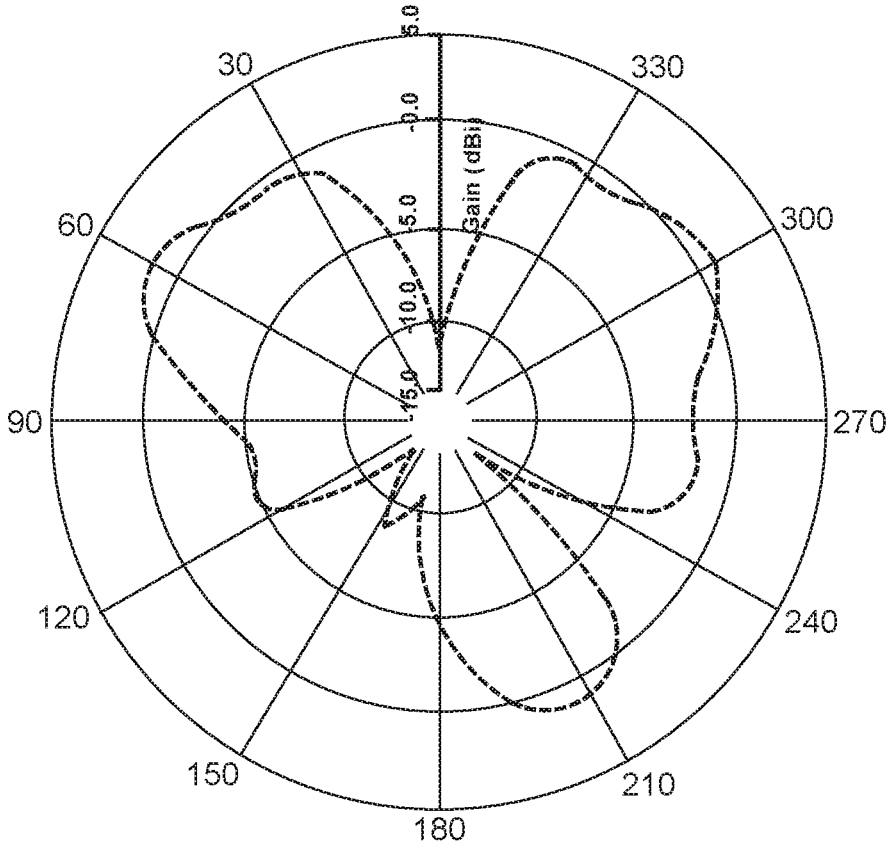
FIG. 7 depicts a graphical representation of an elevation radiation pattern associated with a first antenna structure of an antenna system according to example embodiments of the present disclosure.

FIG. 7 depicts a graphical representation of an elevation plane radiation pattern associated with the first antenna structure 130 (FIG. 1) according to example embodiments of the present disclosure. More specifically, the graph depicts the elevation radiation pattern of the first antenna structure when tuned to the first frequency. As shown, the elevation radiation pattern can include a main lobe and a plurality of side lobes. In this manner, the elevation radiation pattern associated with the first antenna structure 130 can be considered directional when the first antenna structure 130 is tuned to the first frequency.

Figure 8:
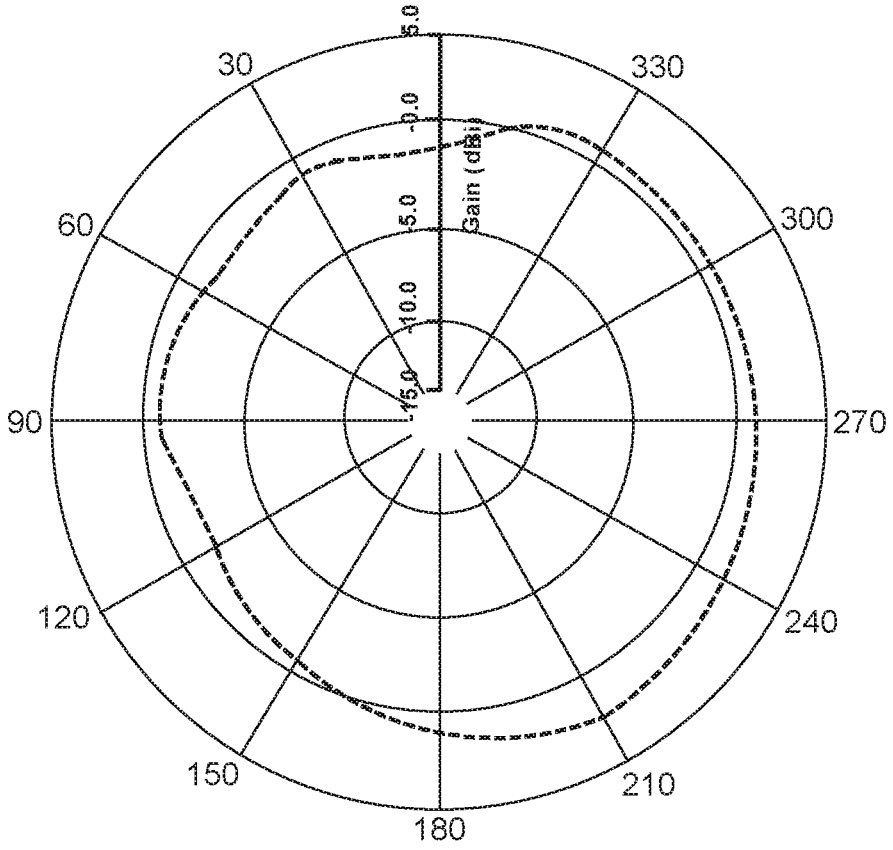
FIG. 8 depicts a graphical representation of an azimuthal radiation pattern associated with a second antenna structure of an antenna system according to example embodiments of the present disclosure.

Referring now to FIG. 8, a graphical representation of an azimuthal radiation pattern associated with the second antenna structure 140 (FIG. 1) is provided according to example embodiments of the present disclosure. More specifically, the graph depicts the azimuthal plane radiation pattern of the second antenna structure 140 when tuned to the second frequency (e.g., about 1918 MHz). As shown, the gain of the second antenna structure 140 is generally uniform in the azimuthal plane. In this manner, the azimuthal radiation pattern associated with the second antenna structure 140 can be considered omnidirectional when the second antenna structure 140 is tuned to the second frequency.

Figure 9:
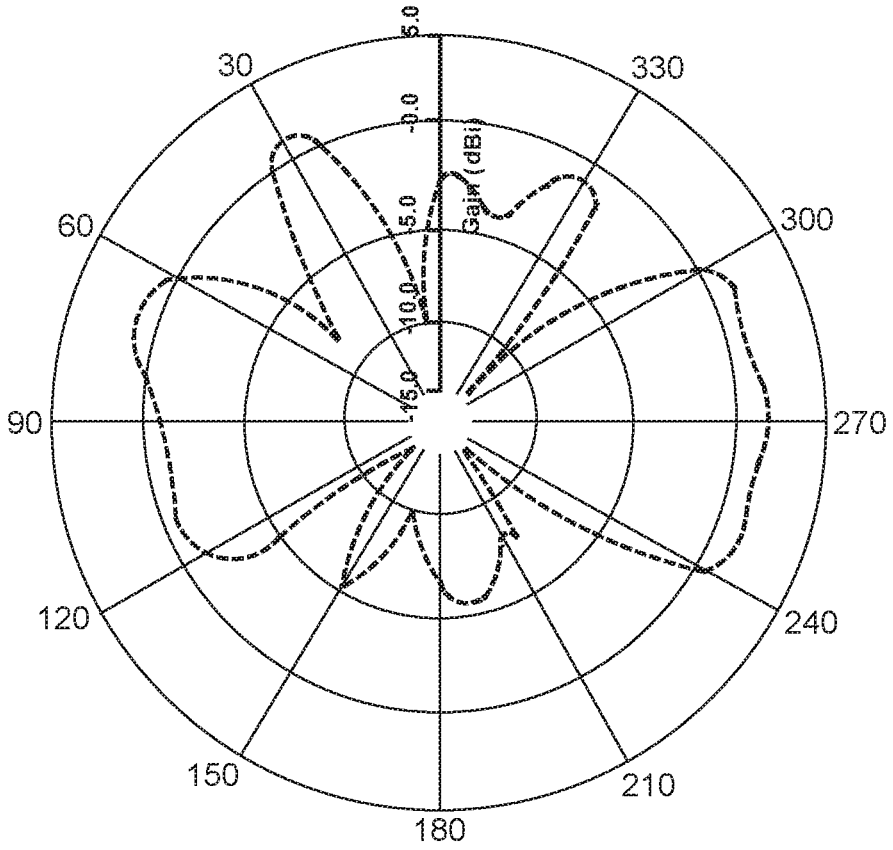
FIG. 9 depicts a graphical representation of an elevation radiation pattern associated with a second antenna structure of an antenna system according to example embodiments of the present disclosure.

FIG. 9 depicts a graphical representation of an elevation plane radiation pattern associated with the second antenna structure 140 according to example embodiments of the present disclosure. More specifically, the graph depicts the elevation radiation pattern of the second antenna structure 140 when tuned to the second frequency. As shown, the elevation radiation pattern can include a main lobe, a back lobe, and side lobes. In this manner, the elevation radiation pattern associated with the second antenna structure 140 can be considered directional when the second antenna structure 140 is tuned to the second frequency.

Figure 10:
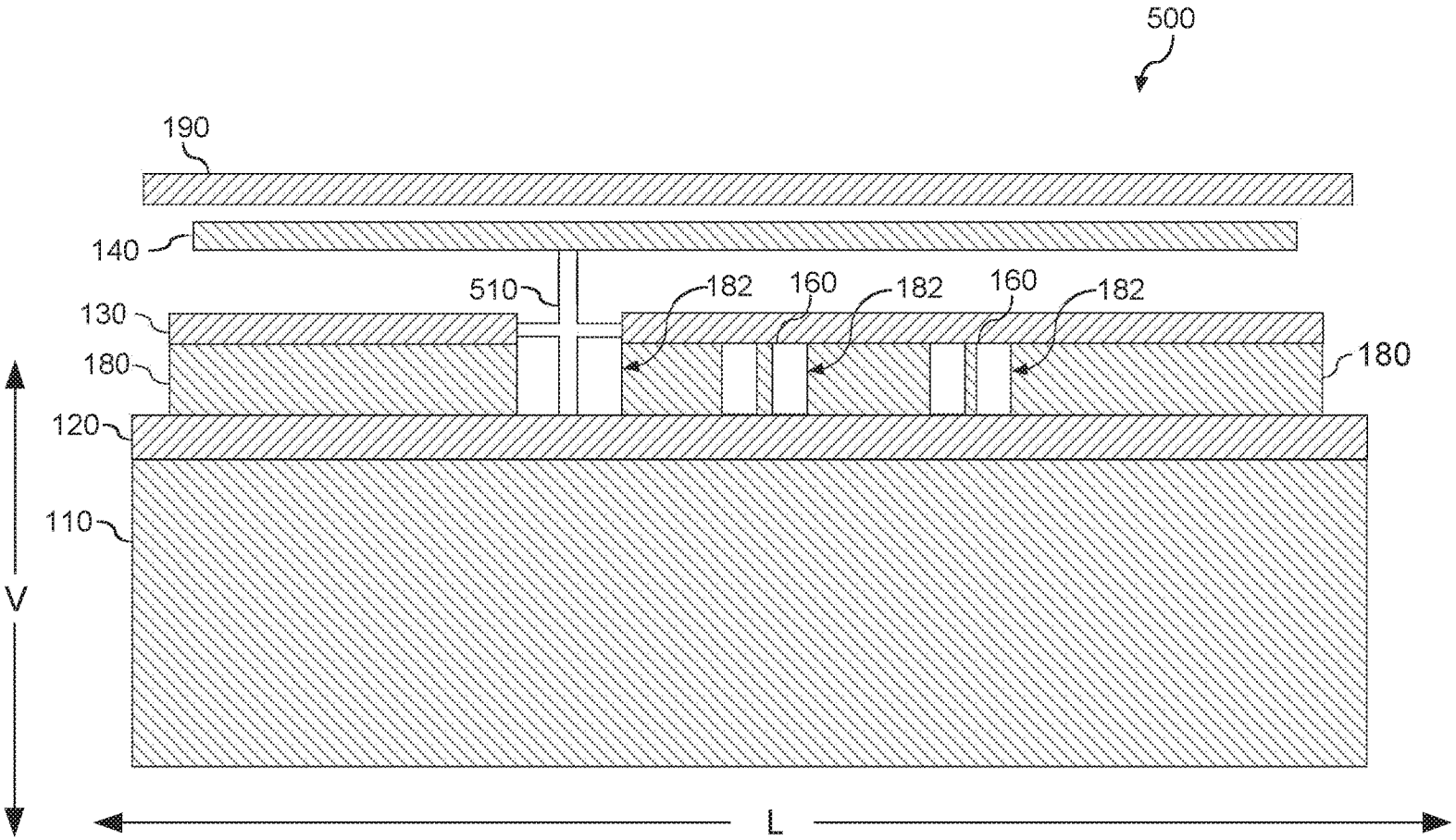
FIG. 10 depicts a cross-sectional view of an antenna system according to example embodiments of the present disclosure.

Referring now to FIG. 10, another embodiment of the antenna system 500 is provided according to example embodiments of the present disclosure. The antenna system 500 of FIG. 10 can include the same or similar components as the antenna system 100 discussed above with reference to FIGS. 1 through 4. For instance, the antenna system 500 of FIG. 10 can include the first antenna structure 130 and the second antenna structure 140. However, in contrast to the antenna system 100 depicted in FIGS. 1 through 4, the first antenna structure 130 and second antenna structure 140 of the antenna system 500 depicted in FIG. 10 are not coupled to the circuit board 120 via separate conductive antenna feed paths. Instead, the first antenna structure 130 and the second antenna structure 140 are each coupled to the circuit board 120 via the same conductive antenna feed path 510. In addition, the second antenna structure 140 of FIG. 10 is not electrically grounded to the first antenna structure 130 via one or more shorting posts 170 (FIG. 2).

Figure 11:
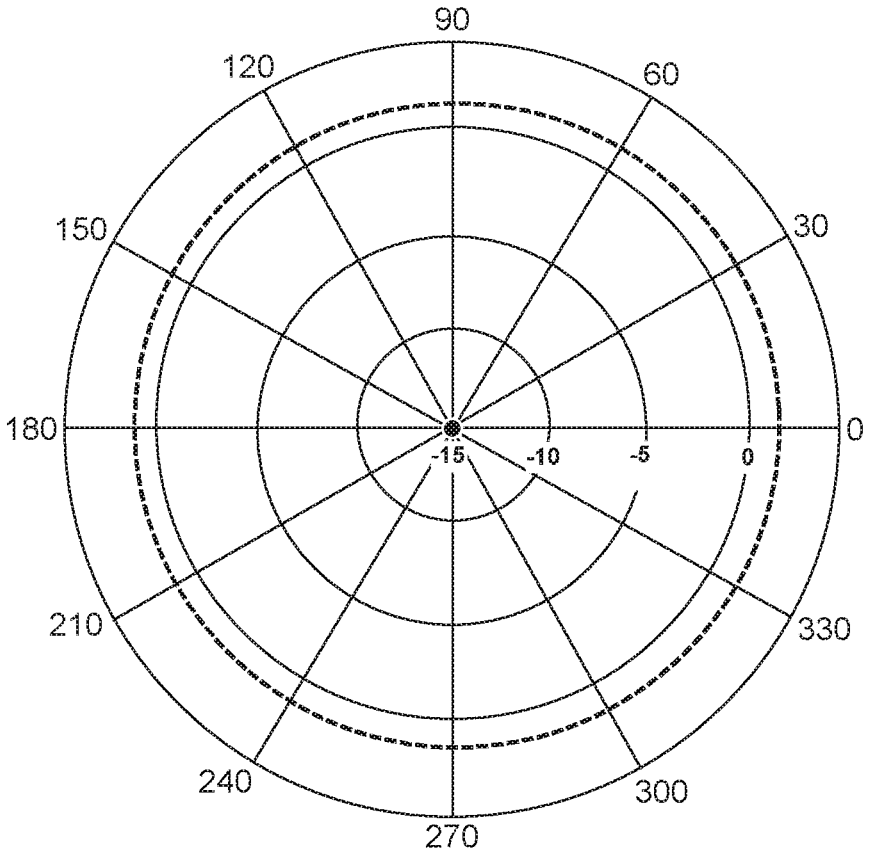
FIG. 11 depicts a graphical representation of an azimuthal radiation pattern associated with a first antenna structure of an antenna system according to example embodiments of the present disclosure.

Referring now to FIG. 11, a graphical representation of an azimuthal plane radiation pattern associated with the first antenna system 500 (FIG. 10) according to example embodiments of the present disclosure. More specifically, the graph depicts the azimuthal plane radiation pattern of the first antenna structure 130 when tuned to a first frequency (e.g., about 725 MHz). As shown, the radiation pattern is generally uniform in the azimuthal plane. In this manner, the azimuthal radiation pattern associated with the first antenna structure 130 can be omnidirectional when the first antenna structure 130 is tuned to the first frequency.

Figure 12:
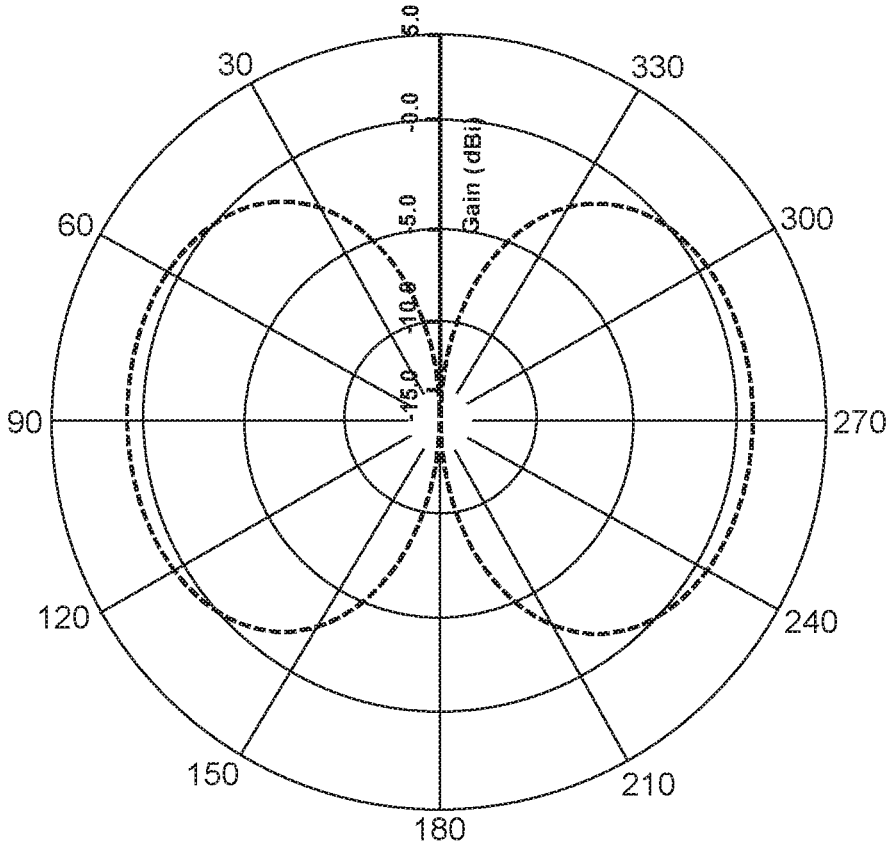
FIG. 12 depicts a graphical representation of an elevation radiation pattern associated with a first antenna structure of an antenna system according to example embodiments of the present disclosure.

FIG. 12 depicts a graphical representation of an elevation plane radiation pattern associated with the antenna system 500 (FIG. 10) according to example embodiments of the present disclosure. More specifically, the graph depicts the elevation radiation pattern associated with the first antenna structure 130 when tuned to the first frequency. As shown, the elevation radiation pattern can include side lobes. In this manner, the elevation radiation pattern associated with the first antenna structure 130 can be directional when the first antenna structure 130 is tuned to the first frequency.

Figure 13:
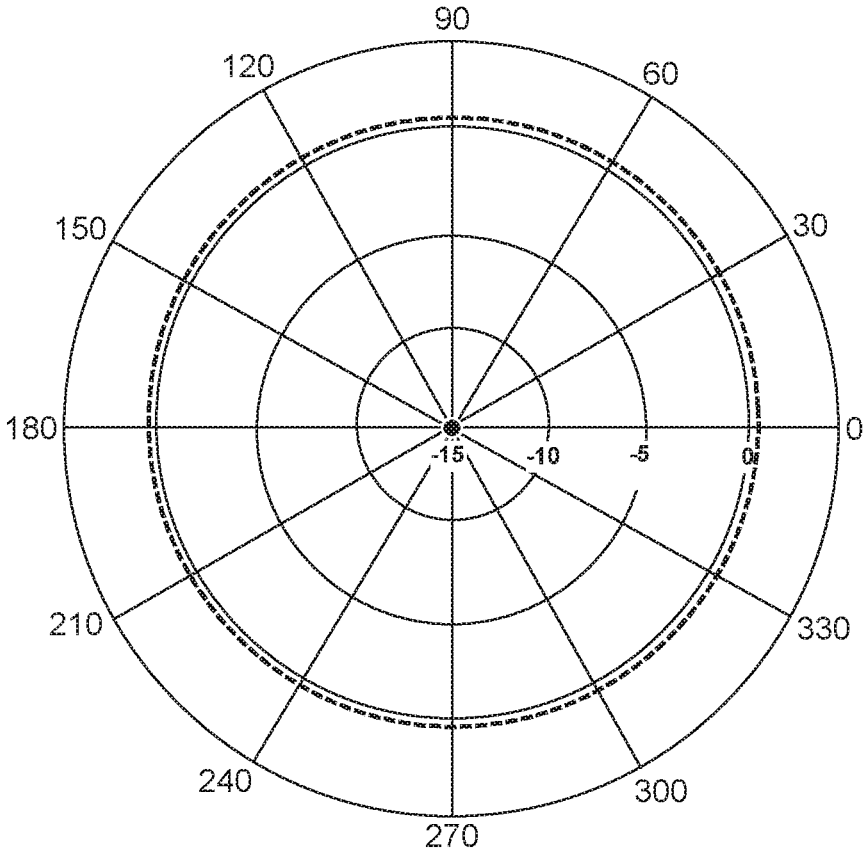
FIG. 13 depicts a graphical representation of an azimuthal radiation pattern associated with a first antenna structure of an antenna system according to example embodiments of the present disclosure.

Referring now to FIG. 13, a graphical representation of an azimuthal radiation pattern associated with the antenna system 500 (FIG. 10) is provided according to example embodiments of the present disclosure. More specifically, the graph depicts the azimuthal plane radiation pattern associated with the first antenna structure 130 when tuned to a first frequency (e.g., about 1918 MHz). As shown, the radiation pattern is generally uniform in the azimuthal plane. In this manner, the azimuthal radiation pattern associated with the first antenna structure 130 can be omnidirectional when the first antenna structure 130 is tuned to the first frequency.

Figure 14:
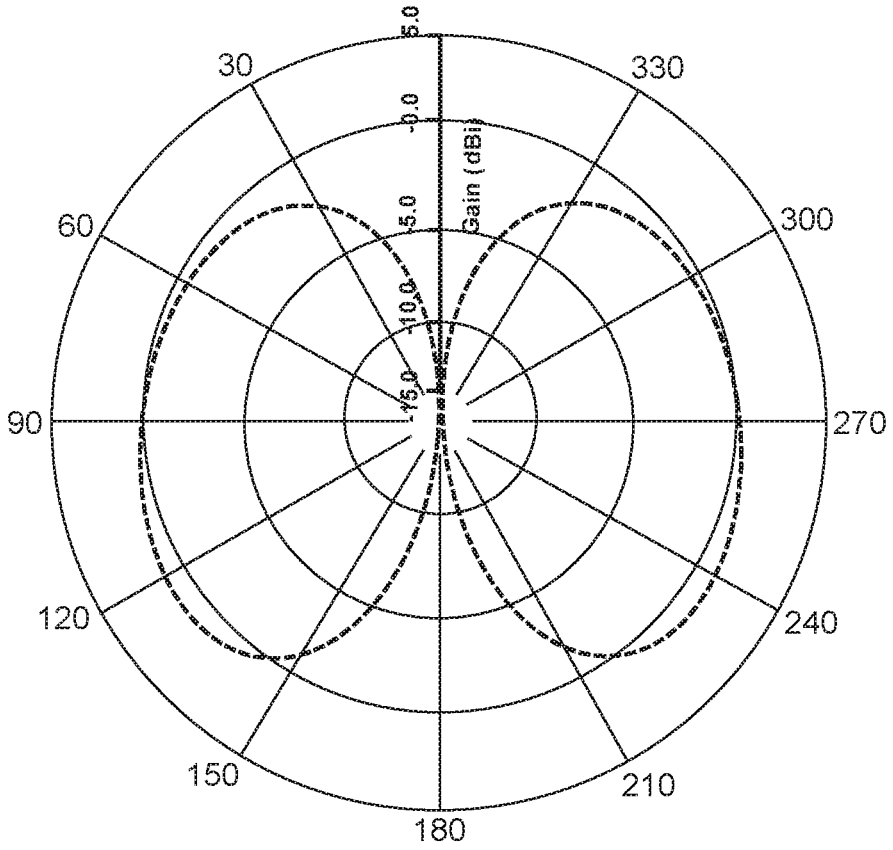
FIG. 14 depicts a graphical representation of an elevation radiation pattern associated with a first antenna structure of an antenna system according to example embodiments of the present disclosure.

FIG. 14 depicts a graphical representation of an elevation plane radiation pattern associated with the antenna system 500 (FIG. 10) according to example embodiments of the present disclosure. More specifically, the graph depicts the elevation radiation pattern of the first antenna structure 130 when tuned to the first frequency (e.g., about 1918 MHz). As shown, the elevation radiation pattern can include side lobes. In this manner, the elevation radiation pattern associated with the first antenna structure 130 can be directional when the first antenna structure 130 is tuned to the first frequency.

Figure 15:
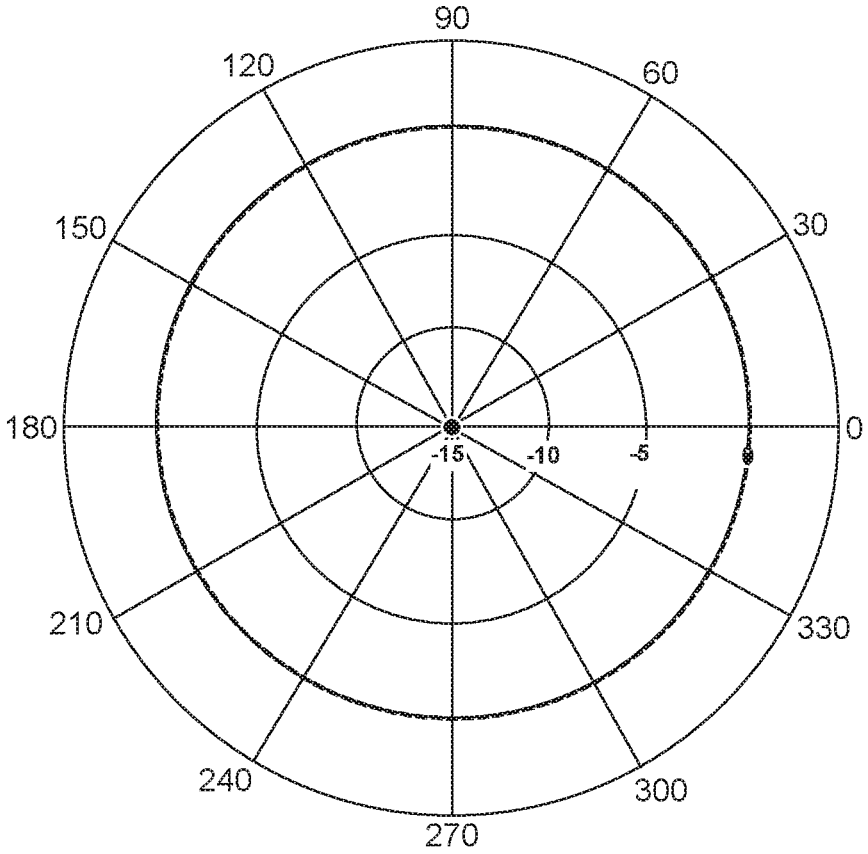
FIG. 15 depicts a graphical representation of an azimuthal radiation pattern associated with a second antenna structure of an antenna system according to example embodiments of the present disclosure.

Referring now to FIG. 15, a graphical representation of an azimuthal radiation pattern associated with the antenna system 500 (FIG. 10) is provided according to example embodiments of the present disclosure. More specifically, the graph depicts the azimuthal plane radiation pattern of the second antenna structure 140 when tuned to the second frequency (e.g., about 2008 MHz). As shown, the radiation pattern is generally uniform in the azimuthal plane. In this manner, the azimuthal radiation pattern associated with the second antenna structure 140 can be omnidirectional when the second antenna structure 140 is tuned to the second frequency.

Figure 16:
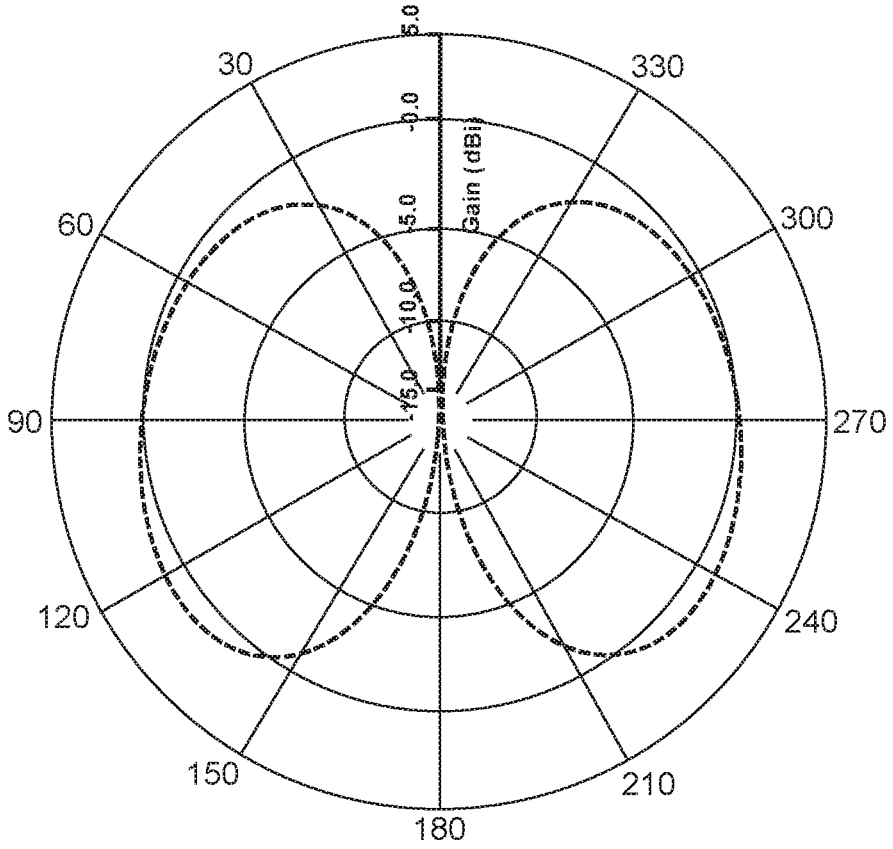
FIG. 16 depicts a graphical representation of an elevation radiation pattern associated with a second antenna structure of an antenna system according to example embodiments of the present disclosure.

FIG. 16 depicts a graphical representation of an elevation plane radiation pattern associated with the antenna system 500 (FIG. 10) according to example embodiments of the present disclosure. More specifically, the graph depicts the elevation radiation pattern of the of the second antenna structure 140 when tuned to the second frequency. As shown, the elevation radiation pattern can include side lobes. In this manner, the elevation radiation pattern associated with the second antenna structure 140 can be directional when the second antenna structure 140 is tuned to the second frequency.

Figure 17:
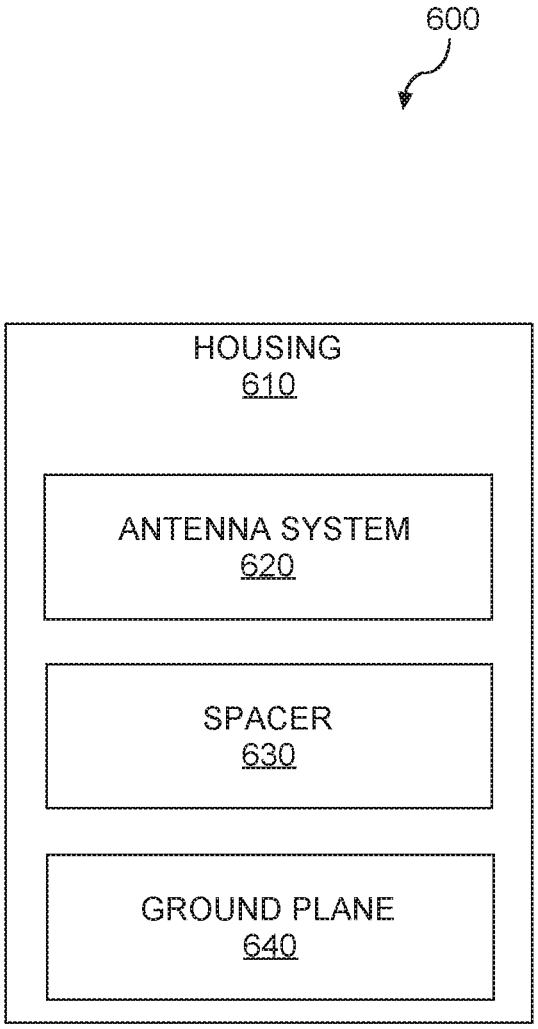
FIG. 17 depicts a block diagram of components of a module according to example embodiments of the present disclosure.

Referring now to FIG. 17, a block diagram of components of a unit or module 600 is provided according to example embodiments of the present disclosure. As shown, the module 600 can include a housing 610. The module 600 can further include an antenna system 620 disposed within the housing 610. It should be appreciated that the antenna system 620 include any suitable antenna system. In some implementations, the antenna system 620 can correspond to the antenna system 100 discussed above with reference to FIGS. 1 through 4. In alternative implementations, the antenna system 620 can correspond to the antenna system 500 discussed above with reference to FIG. 10.

In some implementations, the module 600 can include a spacer 630 positioned between the antenna system 620 and a ground plane 640 associated with the module 600. More specifically, the spacer 630 can be positioned between the ground plane 640 and the power supply 110 (FIGS. 1 and 10) of the antenna system 620. In this manner, the antenna system 620 can be separated from the ground plane 640 of the module 600.

It should be appreciated that the spacer 630 can include any suitable material. For instance, in some implementations, the spacer 630 can include a foam material. It should also be appreciated that a cross-sectional area of the ground plane 640 of the module 600 can be larger than a cross-sectional area of the circuit board 120 (FIGS. 1 and 10) of the antenna system 620. In this manner, the ground plane 640 of the module 600 can inhibit back propagation of RF waves emitted via the first antenna structure 130 (FIGS. 1 and 10) of the antenna system 620. In some implementations, the antenna systems of FIGS. 1 and 10 each have a height of 10 mm in the vertical direction.

Figure 18:
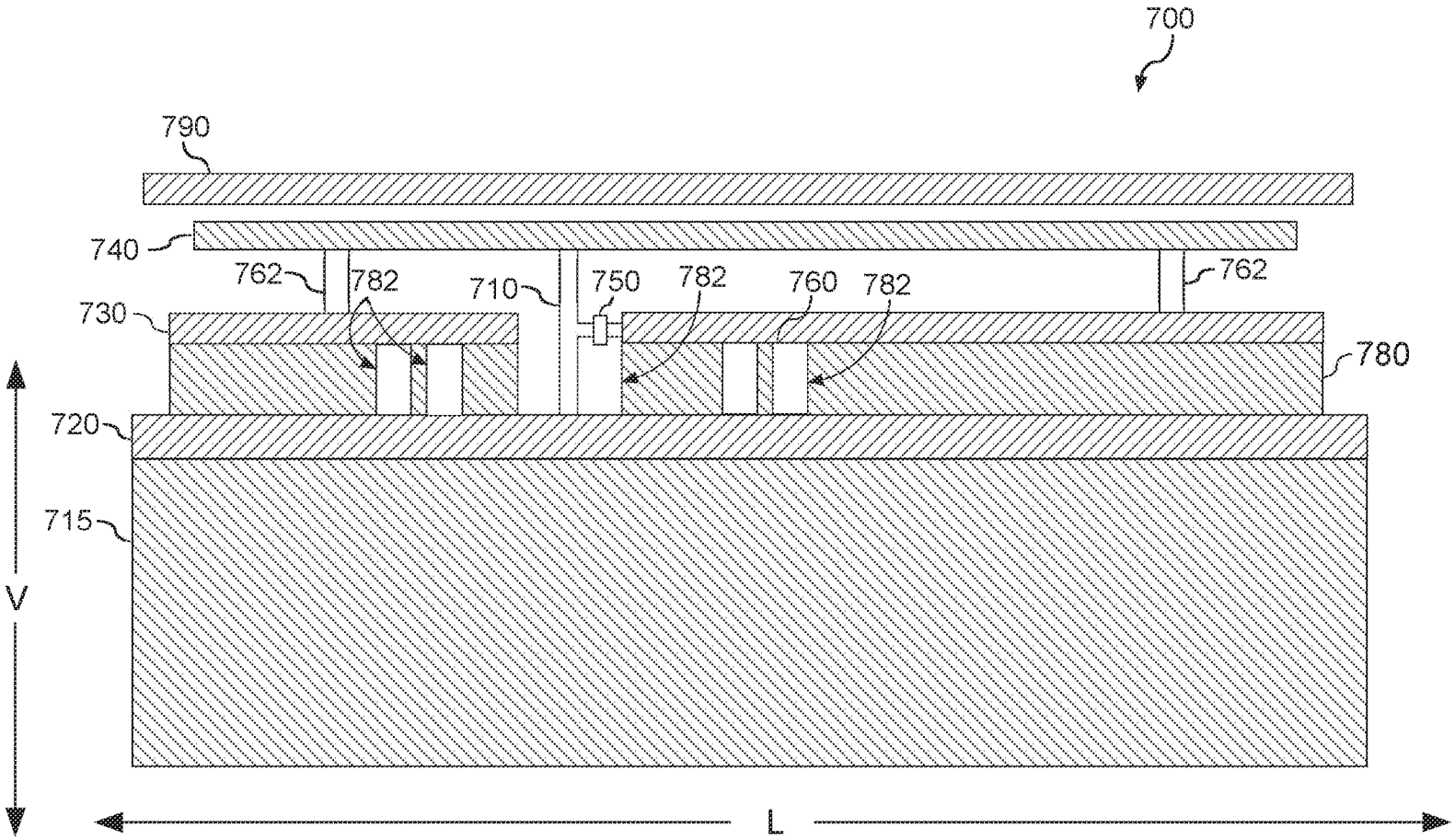
FIG. 18 depicts a cross-sectional view of an antenna system according to example embodiments of the present disclosure.

FIG. 18 depicts a cross-sectional view of an antenna system 700 according to another example embodiment of the present disclosure. The antenna system 700 can include a first antenna structure 730, a second antenna structure 740, and a circuit board 720. The first antenna structure 730 can be disposed between the circuit board 720 (e.g., a ground plane on the circuit board) and the second antenna structure 740. More specifically, the first antenna structure 730 can be disposed between the circuit board 720 and the second antenna structure 740 along the vertical direction V. In addition, a cross-sectional area of the first antenna structure 730 can be different than a cross-sectional area of the second antenna structure 740. More specifically, the cross-sectional area of the first antenna structure 730 can be larger than the cross-sectional area of the second antenna structure 740. In this manner, the first antenna structure 130 can form a ground plane for the second antenna structure 740.

In some implementations, a shape of the first antenna structure 730 can be different than a shape of the second antenna structure 740. For instance, the shape of the first antenna structure 730 can be rectangular. Conversely, the shape of the second antenna structure 740 can be annular (e.g., ring, circle, oval). It should be appreciated, however, that the first antenna structure 730 and the second antenna structure 740 can have any suitable shape so long as the cross-sectional area of the first antenna structure 730 is greater than the cross-sectional area of the second antenna structure 740.

In some implementations, a cross-sectional area of a ground plane on the circuit board 720 can be different than the cross-sectional area of the first antenna structure 730. For instance, the cross-sectional area of the circuit board 720 can be greater than the cross-sectional area of the first antenna structure 730. As will be discussed below in more detail, the first antenna structure 730 and the second antenna structure 740 can each be electrically coupled to the circuit board 720 using a common antenna feed (e.g., conductive antenna feed path 710).

The first antenna structure 730 can be electrically grounded to the circuit board 720 (e.g. a ground plane on the circuit board 720) via one or more shorting posts 760. It should be appreciated that any suitable number of shorting posts 760 can be used to electrically ground the first antenna structure 730 to the circuit board 720. For instance, as shown in FIG. 18, the first antenna structure 730 can be electrically grounded to the circuit board 720 via two shorting posts 760. In alternative implementations, more or fewer shorting posts 760 can be used to electrically ground the first antenna structure 730 to the circuit board 720.

As shown, the second antenna structure 740 can be electrically grounded to the first antenna structure 730 via one or more shorting posts 762. For instance, as shown in FIG. 18, the second antenna structure 740 can be electrically grounded to the first antenna structure 730 via two shorting posts 762. In alternative implementations, more or fewer shorting posts 762 can be used to electrically ground the second antenna structure 740 to the first antenna structure 730.

In some implementations, the antenna system 700 can include a substrate 780 disposed between the circuit board 720 and the first antenna structure 730. The substrate 780 can include a polymer material (e.g., polycarbonate) having a relatively permittivity, $\varepsilon_r$, of about 3. It should be appreciated, however, that the substrate 780 can include any suitable material. It should also be appreciated that the substrate 780 can define a plurality of openings 782. In this manner, the conductive antenna feed path 710 and plurality of shorting posts 760 can each extend through a corresponding opening of the plurality of openings 782 defined by the substrate 780.

In some implementations, the antenna system 700 can include a cover 790. As shown, the first antenna structure 730 and the second antenna structure 740 can be positioned between the circuit board 720 and the cover 790 along the vertical direction V. In addition, a cross-sectional area of the cover 790 can be greater than the cross-sectional area of the first antenna structure 730 and the cross-sectional area of the second antenna structure 740. In this manner, the first antenna structure 730 and the second antenna structure 740 can be covered via the cover 790. It should be appreciated that the cover 790 can include any suitable material. For instance, in some implementations, the cover 790 can include plastic (e.g., polyurethane). It should also be appreciated that the cover 790 can be any suitable size. For instance, in some implementations, a thickness of the cover 790 as measured along the vertical direction V can be about 2 millimeters. The antenna system 700 can include a power supply 715, such as a battery.

According to example aspects of the present disclosure, a filter 750 (e.g., an LC filter) can be placed (e.g., coupled) between the conductive antenna feed path 710 and the first antenna structure 730. The filter 750 can include one or more inductors and/or one or more capacitors. The filter 750 can be implemented in the antenna system 700, for instance, using surface mount technology (e.g., via one or more solder pads) in a path between the conductive antenna feed path 710 and the first antenna structure 730.

Figure 19:
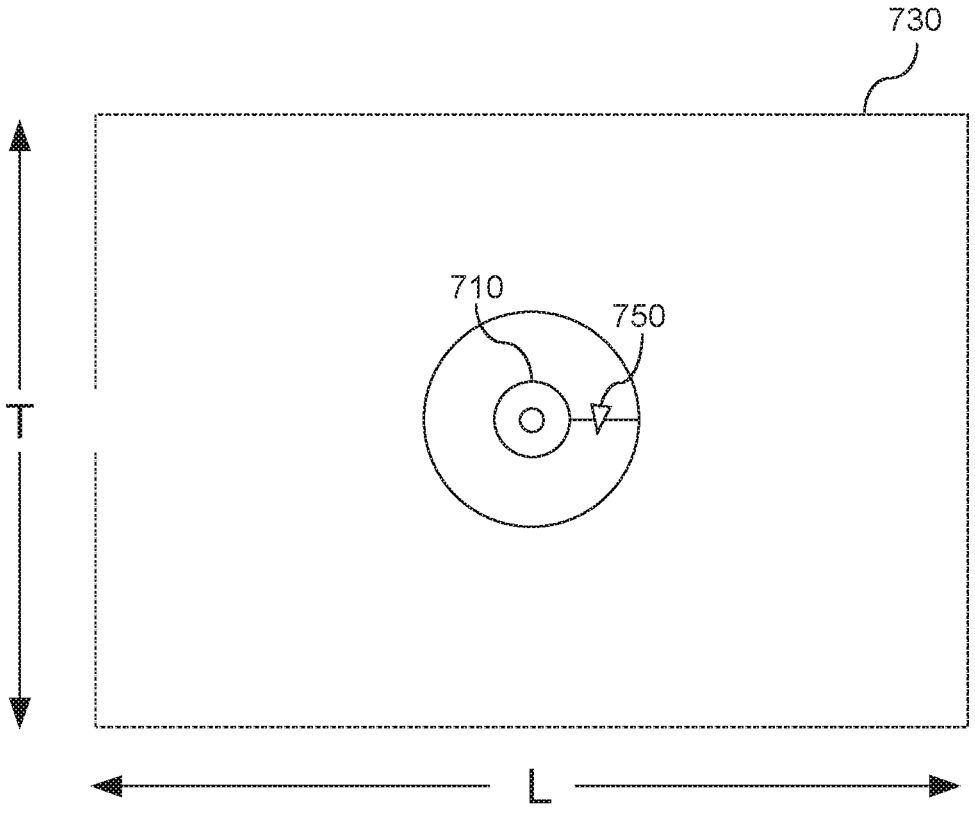
FIG. 19 depicts a plan view of a portion of a first antenna structure according to example embodiments of the present disclosure.

FIG. 19 depicts a plan view of a portion of the first antenna structure 730. As shown the conductive antenna feed path 710 passes through the first antenna structure 730. The conductive antenna feed path 710 is coupled to the first antenna structure 730 via a path that includes filter 750.

In some embodiments, the filter 750 can be figured to pass component of RF signals having a frequency associated with the first antenna structure 730 and to block components of RF signals having a frequency associated with the second antenna structure 730. For instance, in some embodiments, the filter 750 can be configured to pass components of RF signals having a frequency in the range of about 722 MHz to about 728 MHz. The filter 750 can be configured to block components of RF signals having a frequency in the range of about 1915 MHz to 2020 MHz. This can further enhance the antenna system functioning in the low and high band regions independently of one another.

FIGS. 18 and 19 depict a filter placed between the common conductive antenna feed path and the first antenna structure for example purposes. The filter could also be placed between the common conductive antenna feed path and the second antenna structure without deviating from the scope of the present disclosure. The antenna system could also include a first filter placed between the common conductive antenna feed path and the first antenna structure and a second filter placed between the common conductive antenna feed path and the second antenna structure.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An antenna system comprising:

a circuit board;

a first antenna structure electrically coupled to the circuit board via a first conductive antenna feed path;

a first shorting post electrically grounding the first antenna structure to the circuit board, the first shorting post extending through a first opening of a plurality of openings defined by a substrate positioned between the circuit hoard and the first antenna structure;

a second antenna structure electrically coupled to the circuit board via a second conductive antenna feed path extending through an opening defined by the first antenna structure; and a second shorting post positioned outside of the first opening of the plurality of openings, the second shorting post positioned closer to a periphery of the first antenna structure than a center of the first antenna structure, the second shorting post electrically grounding the second antenna structure to the first antenna structure, the second shorting post having a first end connected to the first antenna structure and a second end connected to the second antenna structure, wherein the first antenna structure is positioned between the circuit board and the second antenna structure to provide a ground plane for the second antenna structure.

2. The antenna system of claim 1, wherein:

the first antenna structure is tuned to a first frequency; and the second antenna structure is tuned to a second frequency that is different than the first frequency.

3. The antenna system of claim 2, wherein:

the first frequency ranges from about 722 megahertz to about 728 megahertz; and the second frequency ranges from about 1995 megahertz to about 2020 megahertz.

4. The antenna system of claim 3, further comprising:

a filter coupled between the first conductive antenna feed path and the first antenna structure.

5. The antenna system of claim 4, wherein the filter is configured to pass the first frequency and block the second frequency.

6. The antenna system of claim 1, wherein the first antenna structure and the second antenna structure each include a top loaded monopole S antenna having one or more shorting posts.

7. The antenna system of claim 1, wherein a cross-sectional area of the first antenna structure is larger than a cross-sectional area of the second antenna structure such that the first antenna structure provides a ground plane for the second antenna structure.

8. The antenna system of claim 1, wherein the first antenna structure has a non-annular shape and the second antenna structure has an annular shape.

9. A module, comprising:

a housing; and an antenna system disposed within the housing, the antenna system comprising:

a circuit board;

a first antenna structure electrically coupled to the circuit board via a first conductive path, the first antenna structure tuned to a first frequency;

a first shorting post electrically grounding the first antenna structure to the circuit board, the first shorting post extending through a first opening of a plurality of openings defined by a substrate positioned between the circuit board and the first antenna structure;

a second antenna structure electrically coupled to the circuit board via a second conductive path extending through an opening defined by the first antenna structure, the second antenna structure tuned to a second frequency that is different than the first frequency; and a second shorting post positioned outside of the first opening of the plurality of openings, the second shorting post positioned closer to a periphery of the first antenna structure than a center of the first antenna structure, the second shorting post electrically grounding the second antenna structure to the first antenna structure, the second shorting post having a first end connected to the first antenna structure and a second end connected to the second antenna structure, wherein the first antenna structure is positioned between the circuit board and the second antenna structure to provide a ground plane for the second antenna structure.

10. The module of claim 9, wherein:

the first conductive path extends through a second opening of the plurality of openings defined by the substrate;

the second conductive path extends through a third opening of the plurality of openings defined by the substrate.

11. The module of claim 9, wherein the substrate includes a polycarbonate material.

12. The module of claim 9, wherein the antenna system further comprises:

an energy storage device coupled to the circuit board such that the circuit board is positioned between the first antenna structure and the energy storage device.

13. The module of claim 12, further comprising:

a spacer disposed between the energy storage device and a ground plane associated with the module.

14. The module of claim 9, further comprising:

a filter coupled between the first antenna structure and the second conductive path.

15. An antenna system comprising:

a circuit board;

a first antenna structure electrically grounded to the circuit board via a shorting post extending through a first opening of a plurality of openings defined by a substrate positioned between the circuit board and the first antenna structure, the first antenna structure tuned to a first frequency;

a second antenna structure tuned to a second frequency that is different than the first frequency; and a conductive antenna feed path comprising a horizontal portion and a vertical portion, the horizontal portion electrically coupling the first antenna structure to the circuit board, the vertical portion electrically coupling the second antenna structure to the circuit board, wherein the first antenna structure is positioned between the circuit board and the second antenna structure to provide a ground plane for the second antenna structure.

16. The antenna system of claim 15, wherein the conductive antenna feed path extends through an opening defined by the first antenna structure.

17. The antenna system of claim 15, further comprising:

a cover positioned such that the first antenna structure and the second antenna structure are positioned between the cover and the circuit board, the cover having a cross-sectional area that is larger than a cross-sectional area of the first antenna structure and a cross-sectional area of the second antenna structure.

* * * * *